United States Patent [19]

Barnabie et al.

[11] Patent Number: 5,062,575

[45] Date of Patent: Nov. 5, 1991

[54] COMMINUTOR WITH IMPACT, SHEAR AND SCREENING SECTIONS

[75] Inventors: Edward J. Barnabie, Turnersville, N.J.; John D. Duke, Jr., Collingdale, Pa.

[73] Assignee: Pennsylvania Crusher Corporation, Broomall, Pa.

[21] Appl. No.: 495,975

[22] Filed: Mar. 20, 1990

Related U.S. Application Data

[63] Continuation of Ser. No. 298,233, Jan. 9, 1989, abandoned, which is a continuation of Ser. No. 47,091, May 8, 1987, abandoned.

[51] Int. Cl.[5] ..... B02C 13/282

[52] U.S. Cl. ..... 241/73; 241/88.4; 241/189 A; 241/190

[58] Field of Search ..... 241/73, 88.4, 89.3, 241/189 A, 89.1, 89.2, 189 R, 190

[56] References Cited

U.S. PATENT DOCUMENTS

| | | |
|---|---|---|
| Re. 23,468 | 3/1952 | Wilson . |
| 1,872,233 | 8/1932 | Borton . |
| 2,012,416 | 8/1935 | Bartels . |
| 2,149,571 | 3/1939 | Battey . |
| 2,170,407 | 8/1939 | Hartshorn . |
| 2,287,799 | 6/1942 | Hartshorn . |
| 2,440,388 | 4/1948 | Wright . |
| 2,478,733 | 8/1949 | Wright . |
| 2,767,929 | 10/1956 | West . |
| 2,977,055 | 3/1961 | Fawcett . |
| 3,465,973 | 9/1969 | Williams . |
| 3,591,096 | 7/1971 | DeFeo . |
| 3,617,007 | 11/1971 | Bonarrigo . |

OTHER PUBLICATIONS

Reversible Hammermills, Pennsylvania Crusher Corporation.

The Cyclone Furnace.

*Primary Examiner*—Mark Rosenbaum

*Attorney, Agent, or Firm*—Pollock Vande Sande & Priddy

[57] ABSTRACT

A reversible hammermill with breaker blocks or plates and one or more adjustable cages equipped with distinct shearing and screening sections, and having a shearing section of greater than normal length having a commencement point above the 3 o'clock position, useful for reducing coal and like materials including subbituminous coal to finer particle sizes with minimal horsepower and through-put penalities.

17 Claims, 4 Drawing Sheets

COMMINUTOR WITH IMPACT, SHEAR AND SCREENING SECTIONS

RELATED APPLICATIONS

This application is a continuation of prior co-pending application Ser. No. 07/298,233, filed Jan. 4, 1989, now abandoned, which was in turn a continuation of prior co-pending application Ser. No. 07/047,091, filed Mar. 8, 1987, now abandoned.

TECHNICAL FIELD

The present invention relates to comminutors having: at least one rotor with a number of protruding hammers, including pivoting hammers, ring hammers, fixed radial paddles or other impacting elements; stationary impact breaking members to receive and further break feed material broken and thrown off by the hammers; and at least one adjustable cage mounted in cooperating relationship with the rotor, said cage including both shearing and screening members in the form of bars, grates, ridged plates and other forms. More particularly, the invention relates to hammermills, including reversible hammermills, such as those equipped with one or more breaker blocks or plates and one or more adjustable cages, that are preferably equipped with distinct shearing and screening bars, and are useful for reducing coal and like materials, including sub-bituminous coal, to fine particle sizes.

BACKGROUND OF THE INVENTION

Reversible hammermills are particularly well adapted for processing coal of varying moisture content and hardness into a uniformly sized, fine product of the type required for cyclone furnace installations. Thus, for many years, most if not all of the coal fed to cyclone furnaces in the U.S. has been processed through such mills. The equipment is also used in coal plants and other systems requiring fine product sizes.

Gradual development of the state of the art with respect to this equipment is reflected in U.S. Pat. Nos. 2,149,571, 2,170,407, 2,471,068, 2,478,733, 2,514,111, 2,767,929, 2,819,027, 2,977,055, 3,035,782, 3,083,921, 3,465,973, 3,593,931, 3,617,007 and others.

The material reduction elements of these mills usually include a rotor mounted in the unit for rotation about an axis which is usually horizontal. The rotor comprises a shaft and hammers, including pivoting hammers, ring hammers, radial paddles or other impact members which protrude outwardly, i.e. in a direction which includes a radially outward component. Such hammers or other impact members are usually mounted in one or more circular or staggered arrays about the shaft. For instance, fixed paddles may be mounted in circular or staggered (e.g., helical) arrays on a common shaft. Pivoting hammers and ring hammers may be similarly mounted on sub-shafts secured to a main shaft by disks or spiders. These arrays rotate with the shaft or main shaft as the case may be, and the impact members have peripheral surfaces or edges which define a hammer circle upon rotation of the shaft.

Such units are provided with means for introducing feed particulates, such as coal, rock, other minerals or other materials of varying size and composition. For example, a typical reversible hammermill operating in a cyclone furnace system may receive sub-bituminous coal in pieces having dimensions in the range of about 3"-6"×0". The feed particulates are usually introduced to the rotor from outside the hammer circle. This may, for example, be accomplished by a chute which, in a reversible hammermill, is typically centered above the rotor. Thus introduced, the material approaches the hammer circle with a component of motion directed radially inward with respect to the axis. The portion or arc of the hammer circle within which feed particulates normally first encounter the rotor is referred to herein as the in-feed position.

As is usual in such equipment, the first encounter between a feed particulate and a hammer often results in some breaking of the particulate into sub-particles, some of which may be above and below the upper particle size limit desired in the final product. The hammer flings such sub-particles and any initially uncrushed particulates outward, typically with an approximately tangential motion, against an impact breaker member. This may be a plate or casting, usually free of product screening openings, which may be supported by a housing within which the rotor is mounted.

The impact breaker member is typically mounted opposite a portion of the hammer circle adjacent the in-feed position, so that it can receive the particulates thrown off by the hammers. This member derives its name from the fact that impacting of the received particles against its surface causes further breaking of the particles. Also, this member has a surface or surfaces extending in a direction of rotation of the rotor and convergent with the hammer circle for crowding feed particulates against the rotor. The literature shows a wide variety of impact breaker members fabricated from castings and plates with regular or irregular surfaces and which may, for example, include depressions and jutting portions or may be generally arcuate, including truly arcuate surfaces or a series of flat surfaces arranged in an approximately arcuate fashion. Typically, the impact breaker member is fabricated in several individual sections for ease of installation or replacement.

Downstream of the impact breaker member, there is a cage which has a generally arcuate inner working face that confronts and is adjacent to the hammer circle. It includes a cage frame and plural grinding members supported in the frame. These may be distributed in the frame in one or more arrays for forming the working face. Typically these members are comminuting components which are to some extent elongated in the direction of and lie generally parallel to the rotor axis, meaning that they are more nearly parallel than perpendicular to said axis.

For example, such grinding members may be the comminuting components of single- or multi-piece grates, assemblies of bars, ridged plates or other forms of grinding members, and are mounted and distributed in or on the frame in a generally arcuate pattern at least partially surrounding the hammer circle. As applied to a grate assembly having both peripherally- and axially-extending grate elements, it is the axially-extending elements which are referred to herein as the grinding members, and it is of course these members which are referred to as lying generally parallel with the axis. More typically, the plural grinding members forming the working face of the cage are a series of bars lying substantially parallel to the rotor axis and distributed peripherally in the cage frame to form a working face of substantial area. Such bars are normally provided with spacers to keep the bars apart and to provide free and open communication between the hammer circle and the exterior edges of the bars. In a less typical arrangement, the grinding members may be ridges or other protrusions from or on the surface of an arcuate plate or casting, which may for example resemble a curved washboard. Regardless of the particular configuration of these grinding members, they are angularly spaced from one another about the axis when viewed in transverse cross section and have inner surfaces which confront and are adjacent to the hammer circle.

One popular and widely used reversible hammermill design known as the Pennsylvania TM reversible hammermill has been manufactured by the present inventors' assignee for many years prior to the present invention. In it, at least a portion of the grinding members are shearing members. These are typically distributed in the cage frame in a series, in which they are angularly and consecutively spaced about the rotor axis. Their purpose is to induce the major portion of the feed particulates traversing these shearing members to approach their inner surfaces obliquely, to abrade against their edges and, for the most part, to skip over such surfaces and continue downstream. This causes reduction of the particulates to occur primarily by shear forces (including abrasion) generated by glancing blows, as distinguished from impact reduction occasioned primarily by major changes in the velocity and/or direction of movement of the particulates, such as in the case of frontal collisions of particulates with an unmoveable obstacle. Thus, shearing type reduction usually results from a more oblique approach and collision than reduction with an impact breaker member. In the most recent form of the Pennsylvania TM hammermill extant prior to the present invention, the angular interval of the hammer circle subtended by said shearing members was less than 30 degrees.

In the Pennsylvania TM reversible hammermill, at least a portion of the grinding members are one or more groups of screening members which confront a portion of the hammer circle downstream of the shearing members. Typically, the angular widths of the screening members are about one inch or more and their angular spacing is about three-quarters of an inch or more. Typically, the ratio of angular spacing to angular width is about 0.5 or more, while the number of screening members per inch of working face (measured in the peripheral direction) is less than one. The screening members typically subtend an angular interval corresponding to at least about forty five degrees of the hammer circle. These screening members define a portion of the working face of the cage in which there is open communication between the hammer circle and the outer edges of the screening members. While further impact of particulates with the inner edges and faces of these screening members can and typically does result in some further reduction, including reduction by shearing forces, the distinctive function of these screening members is that they cause the major portion of the feed particulates which traverse them to exit the hammer circle via the spaces between the inner surfaces of the screening members.

For a number of practical reasons, the typical design approach for a Pennsylvania TM reversible hammermill has involved creation of a vertical axis of symmetry (on either side of a plane extending vertically through the axis of the rotor). This has certain advantages as explained by Hartshorn in U.S. Pat. No. 2,170,407, dated Aug. 22, 1939 and based on an application filed on Nov. 2, 1936. The typical design concept has also included dividing the machine into upper and lower portions delineated by an imaginary horizontal plane passing through the same axis or slightly above it. If a transverse cross-section of the machine is visualized as having a large clock face superimposed upon it with the center of the face coinciding with the rotor axis, this horizontal plane may be said to pass through the three o'clock and nine o'clock positions. In Pennsylvania TM reversible hammermills and other closely related equipment, it has been typical for the impact breaker member to be arranged along a portion of the hammer circle extending from about the one o'clock to three o'clock and nine o'clock to eleven o'clock positions. The grinding members, including the screening members and the relatively small expanse of shearing members heretofore employed have generally been distributed at and below the three and nine o'clock positions.

The foregoing arrangement, which has apparently been popular for about a half century (see the above-mentioned Hartshorn patent), has proven quite satisfactory and has been repeated over and over again in machine after machine. There seems to have been little if any dissatisfaction with this aspect of the design.

SUMMARY OF THE INVENTION

The present invention, applicable to reversible hammermills and other comminutors, is aimed at increasing their materials reduction capabilities, in terms of the fineness of the final product, with little or no penalty in terms of decreased mass throughput capacity and/or power consumed per unit of mass processed. These benefits have been attained through the use of shearing members of specified characteristics and altering the geometry, including the extent and positioning, of the shearing members and impact breaker members.

According to the invention, the angular width of the shearing members (width measured in transverse cross section) is about one half inch or more and their angular spacing (also measured in transverse cross section) is about one eighth of an inch or more. The ratio of angular spacing to angular width of the shearing members is about 0.15 or more, while the number of shearing members per inch of that portion of the working face which is occupied by the shearing members (measured in the peripheral direction) is at least one. The angular interval of the hammer circle subtended by the shearing members represents at least about 30 degrees, preferably more than 30 degrees, more preferably at least about 35 degrees, most preferably about 40 to about 45 degrees, and up to about 60 degrees. A portion of the arc subtended by the shearing members, more specifically a portion thereof subtending at least about 10 degrees of the hammer circle, more preferably at least about 15 degrees, most preferably about 20 degrees, and up to about 25 or 30 degrees, extends above the three o'clock position of the hammer circle into a portion of the hammer circle which was heretofore typically confronted by impact breaker members.

Machines constructed in accordance with these principles have demonstrated that it is possible, by replacing impact breaker member area with shearing member area while retaining equivalent screening member area, to increase the fineness production capabilities of the equipment without significant penalty in terms of either mass throughput or horsepower consumed per unit mass processed. These improvements, which can be applied to reversible and non-reversible (e.g., single direction) hammermills and other closely related comminutors, will be illustrated hereinafter by detailed descriptions of certain preferred and exemplary embodiments in the accompanying drawings and in the text which follow.

DESCRIPTION OF EXEMPLARY AND PREFERRED EMBODIMENTS

Figure 1:
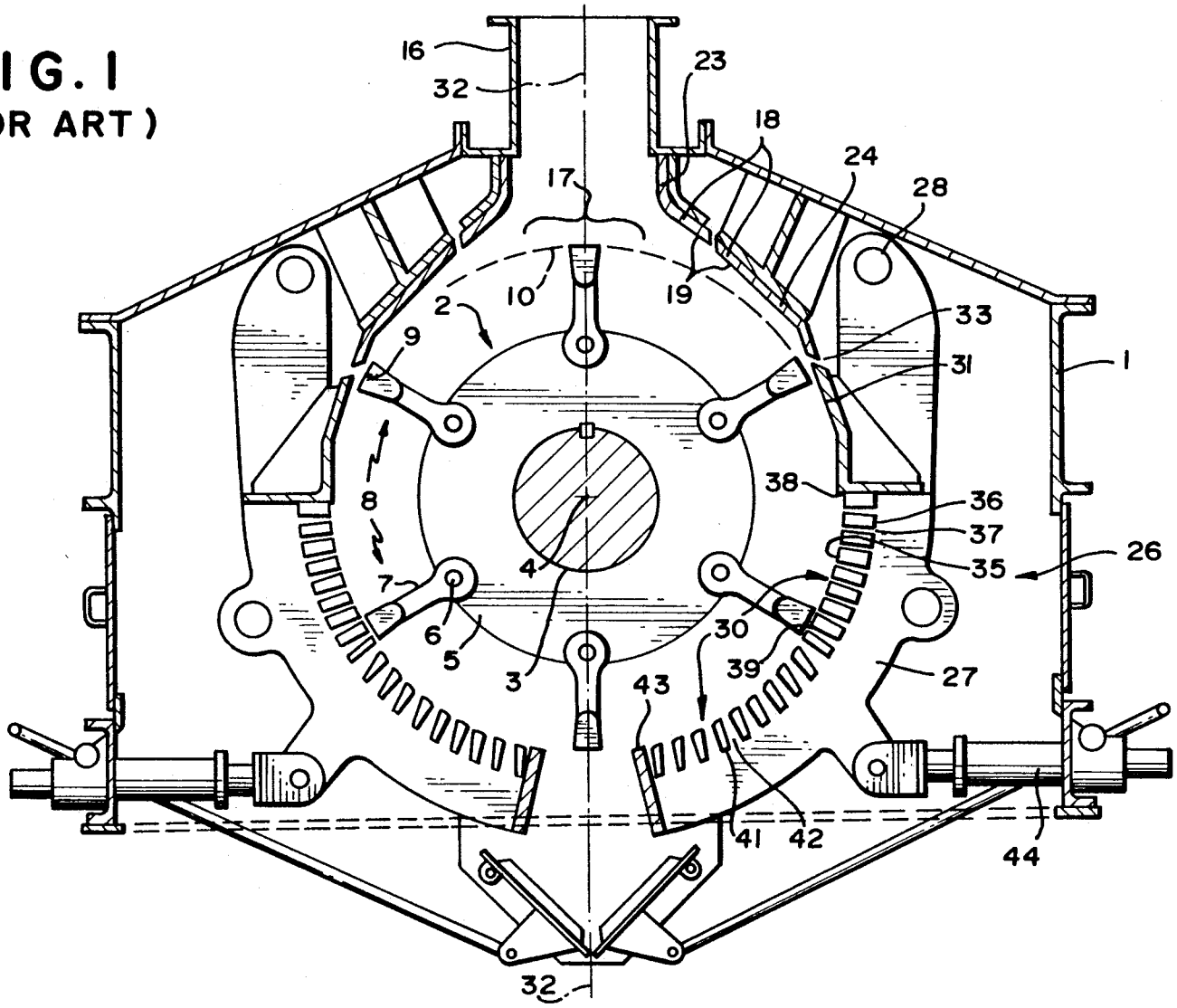
FIG. 1 (PRIOR ART)
FIG. 1 is a transverse cross-section of a prior art reversible hammermill.

Referring to FIG. 1, there is shown a Pennsylvania TM reversible hammermill having a housing 1 equipped with a rotor 2 journaled in suitable bearings (not shown). Rotor 2 comprises shaft 3 having a central axis of rotation 4. Fixedly secured to shaft 3 is rotor disk 5 which supports six subshafts 6 distributed uniformly about the periphery of the disk at equal distances from axis 4. Six pivotable hammers 7 constituting a circular array 8 of such hammers are born by subshafts 6. Rotation of shaft 3 rotates disk 5 carrying subshaft 6 and hammers 7, with the result that the hammers are caused to stand out in radial fashion as a result of the centripetal force exerted thereon. As the hammers rotate, their peripheral surfaces 9 define a hammer circle 10. Persons skilled in the art will readily appreciate that hammermills may have a single array 8 of such hammers, such as may be borne by a pair of disks 5, but more commonly have two, three, four and usually more arrays, borne by an appropriate number of disks.

Housing 1 has an inlet chute 16, constituting means for introducing feed particulates to the rotor. The proper drop height will vary, but will be readily selected by persons skilled in the art so that it is sufficient to insure that the particulate feed normally penetrates the hammer circle without escaping impact with the hammers which are at the apex of their rotation. A portion 17 of hammer circle 10 referred to as the in-feed position is beneath inlet chute 16. Downstream of in-feed position 17, that is, in the direction of hammer rotation and material flow, there is an impact breaker member 18, which may be one or a series of two or more discrete breaker portions arranged adjacent the hammer circle at locations which are progressively further downstream. These members have a surface or surfaces 19 extending in the direction of rotation of the rotor 2 and convergent with the hammer circle 10 for crowding feed particulates against the rotor. In this illustrative embodiment the impact breaker member is divided into first and second portions 23 and 24, both fixed in the apparatus, i.e., suspended from the top of housing 1.

In accordance with typical practice, a cage 26 is located downstream of the impact breaker member 18. The rotor and cage diameters and lengths will depend upon the throughput capacity that is desired. The cage of this embodiment includes a frame 27 suspended from pivot 28 and has a generally arcuate inner working face 30 confronting and adjacent to the hammer circle for cooperation with the rotor. An upstream portion of cage 26 includes a breaker plate 31 which may be regarded as a continuation of the impact breaker member 18.

Note the gap 33 between breaker plate 31 and impact breaker member surface 19 just upstream. This gap and various arrangements utilized in prior attempts to satisfactorily close or seal it have resulted in significant difficulties, in that over-size material escapes through gap 33 and throws off the product specifications and some of the proposed remedies for this problem have proven expensive 13 or time consuming to implement. optional apparatus for overcoming these difficulties is discussed below in connection with FIG. 4.

In the typical reversible hammermill, the rotor is adapted for rotation clockwise or counter clockwise about the shaft axis, and, as shown in FIG. 1, such apparatus typically has a pair of impact breaker members and a pair of cages as above described, one member of each of said pairs being arranged in symmetrical relationship with the other member of the respective pair on opposite sides of a plane of symmetry 32 extending vertically through shaft axis 4.

The aforementioned cages typically comprise plural grinding members supported in the frame in one or more arrays forming the working face 30. These grinding members, which may constitute or be portions of bars, grates, ridges in the surfaces of plates or other forms of grinding members, are arranged in a generally arcuate pattern at least partially surrounding the hammer circle 10 with the lengths of such bars or ridges lying generally parallel to the shaft axis. These grinding members typically have varying amounts of angular space between them, meaning spacing measured in the peripheral direction, and have inner surfaces confronting and adjacent to the hammer circle. As explained above in the background section, the prior art Pennsylvania TM reversible hammermill typically included both shearing bars and screening bars.

The shearing bars 36 had angular spacing 37 of sufficiently small size for preventing entry by the majority of particulates and for causing the major portion of them to traverse the shearing bars, skipping over their inner surfaces 35. Its ends being indicated by reference numerals 38 and 39, the angular interval of hammer circle 10 subtended by shearing bars was for example about 25 degrees or less, and the upstream end 38 of the series of shearing bars was typically located at about the three o'clock position on the hammer circle.

Downstream of the shearing bars were screening bars 41 which were sized and positioned for causing the major portion of feed particulates traversing the series of screening bars to exit the hammer circle via the spaces 42 between the bars. Typically, the angular interval of the hammer circle subtended by said group or groups of screening bars, represented by reference numerals 39 and 43, was about 55 or 60 degrees.

In this prior art equipment there is a pinch point, corresponding in this case to the upstream end of the arcuate interval of the shearing bars, at which the hammer circle 10 approaches closest to the working face 30 of the cage. Typically, means such as screw jacks 44 are provided for adjusting the cage to move the pinch point downstream along the hammer circle as the comminuting components, i.e., the hammers and cage surfaces, wear down from constant abrasion.

Hammermills of this general description have been used for many years in various applications and with good success. However, in recent years there has been a need for improved or substitute equipment which would produce a finer product. How to do so without penalties in throughput and/or horsepower consumption was not apparent. The present invention has provided a solution to this need.

Figure 2:
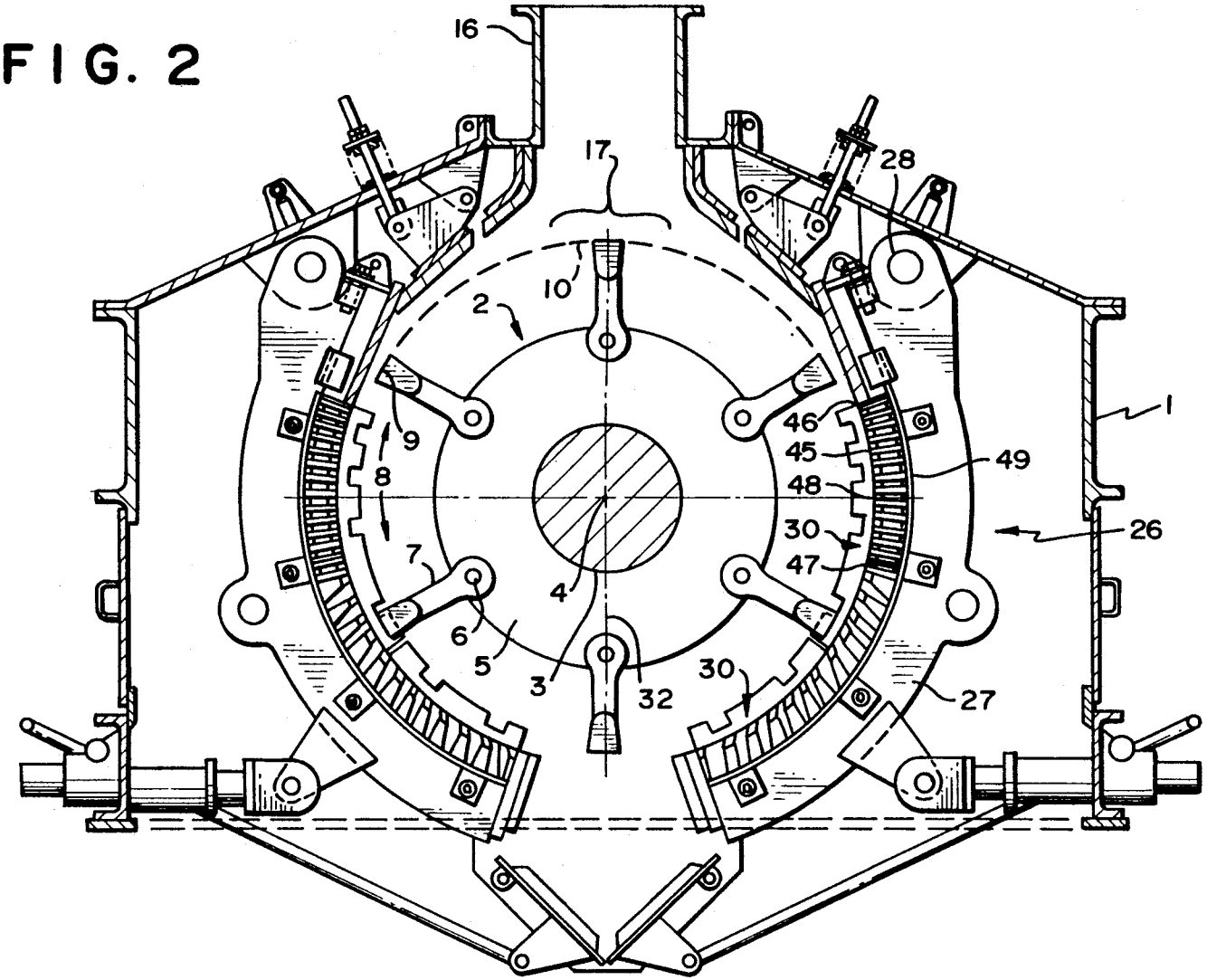
FIG. 2 shows the hammermill of FIG. 1 modified in accordance with the present invention.

FIG. 2, although similar in many respects to FIG. 1, depicts one possible form of the improvements made available by the present invention. This embodiment includes the same housing 1, rotor 2, shaft 3, axis 4, disks 5, subshafts 6, circular array 8 of pivotal hammers 7 and hammer circle 10 shown in FIG. 1. Also, the inlet chute 16 and in-feed position 17 are also the same. Here again, there are impact breaker member 18, a cage 26, frame 27, cage pivot 28 and a cage working face 30. Also, the rotor is adapted for rotation in either direction and pairs of impact breaker members and cages are arranged on opposite sides of a plane of symmetry 32.

Moreover, as in the prior embodiment, this embodiment of the present invention includes plural grinding members forming the working face of the cage, and these are distributed in a generally arcuate pattern at least partially surrounding the hammer circle 10, lying generally parallel to the shaft axis with angular spacing and with their inner surfaces confronting and adjacent to the hammer circle. However, in this embodiment, certain specific relationships are maintained in the shearing members and in the relationship between the shearing members and the impact breaker members which are not suggested in the prior art.

To practice the improvements in impact breaker member/shearing member relationships contemplated by the present invention, one provides shearing bars 45 having specified characteristics. The angular interval 46, 47 subtended by shearing members 45 represents at least about 30 degrees, preferably more than 30 degrees, more preferably at least about 35 degrees, most preferably about 40 to about 45 degrees, and up to a maximum of about 60 degrees. A portion 46, 48 of arc 46, 47 subtends at least about 10 degrees of the hammer circle, more preferably at least about 15 degrees, most preferably about 20 degrees, and up to about 25 or 30 degrees, and extends above the three o'clock position 49 of the hammer circle. This is a portion of the hammer circle which was heretofore typically confronted by impact breaker members 18. At the same time, in accordance with conventional practice, a portion of the shearing member arc, portion 48, 47, extends below the three o'clock position. The extent to which this arc is increased in a downward direction will be governed by the requirement for retaining sufficient screening capacity to process all of the reduced product through the available openings between the screening members.

Figure 3:
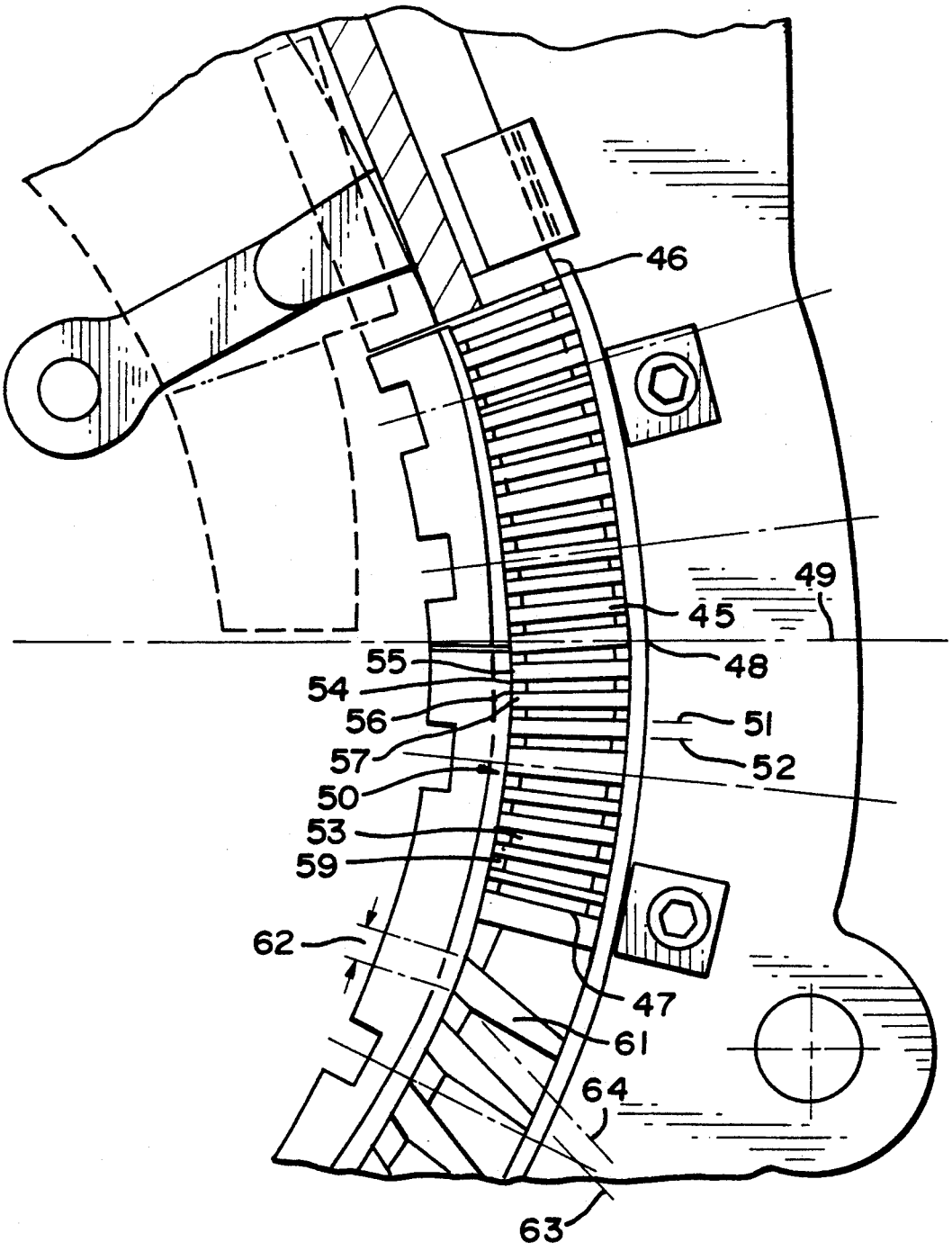
FIG. 3 is an enlarged portion of FIG. 2 showing the shearing members thereof in greater detail.

According to the invention, and as best shown in FIG. 3, in the series 50 of angularly spaced shearing bars 45 the angular width 51, 52 of the shearing bars (width measured in transverse cross section) is preferably less than one inch, generally at least about one half inch or more, and most preferably about one half inch, and their angular spacing 53 (also measured in transverse cross section) is preferably about one eighth to about three-eighths of an inch and most preferably about one fourth inch. The ratio of angular spacing to angular width of the shearing members is about 0.15 or more, while the number of shearing members per peripheral inch of that portion of the working face which is occupied by the shearing members is at least one.

Note that the spacers 59 which maintain the spaced relationship of the bars 45 are usually not continuous in the longitudinal direction and do not therefore block off the passages between the bars. However, to promote the desired shearing action, the widths of the spaces 53 between the bars are of sufficiently small size for preventing entry into said spaces by the majority of particulates passing over the respective bars. On the other hand, the inner downstream edge 54 of each respective bar 55 is preferably separated sufficiently from the inner upstream edge 56 of the next succeeding bar 57 downstream, to provide opportunity for particulates passing over each respective bar to make contact with the inner, upstream edge of the succeeding bar. It will be appreciated that "edge" as used herein does not require a very sharp corner, since the corners of the bars can become somewhat rounded as a result of wear and still contribute to the comminution of the particulate material. As the particulate material skips across the above-mentioned edges of the shearing bars, frictional contact with these edges subjects the particulates to shearing forces resulting in fine grinding. The major portion of feed particulates traversing the shearing bars skips over their inner surfaces and passes to the screening bars 61 downstream. If the spaces between the shearing bars pack full with fine material, as may be the case, more than 90% by weight and even substantially all of the feed particulates skip over the shearing bar inner surfaces and passes to the screening bars.

According to the present embodiment, at least a portion of said grinding members comprise one or more groups of screening members. These are arranged in one or more angularly consecutive series within which the angular width 62 of said screening members is about one inch or more, the angular spacing 63, 64 of said screening members is about three quarters of an inch or more, preferably about three quarters of an inch for smaller diameter machines to about one and a quarter inches for larger diameter machines, and the ratio of angular spacing to angular width of said screening members is about 0.5 or more, preferably about 0.75 for smaller diameter machines to about 1.25 for larger diameter machines. Preferably, the number of screening members per peripheral inch of that portion of the working face occupied by the screening members is less than one, most preferably about 0.57 for smaller diameter machines to about 0.44 for larger diameter machines. Also, the angular interval of the hammer circle subtended by said group or groups of screening members represents at least about 40and preferably at least about 45 degrees. The foregoing parameters are applied and the shape(s) of the bars is (are) selected for causing the major portion of feed particulates traversing the series of screening members to exit the hammer circle via the spaces between the inner surfaces of the screening members.

According to this embodiment, when the comminuting components of the apparatus are substantially unworn, the initial location of the pinch point is at or upstream of the upstream end 46 of the series of shearing bars. In this embodiment, the cage configuration and the capabilities of the adjusting means are such as to move the pinch point from the aforementioned initial location to a location or locations opposite the shearing bars and a substantial distance downstream of upstream end 46 when the comminuting components are substantially worn.

Actual operating experience indicates that the combination of dimensional relationships and positioning of the shearing members described above improves the fine grinding capabilities of the prior art equipment while minimizing throughput and horse power penalties. This comparison is based on retrofitting the invention to an existing Pennsylvania TM reversible hammermill in which the arcuate intervals of the hammer circle subtended by the original series of 1" thick shearing bars in each cage of the unmodified machine was 20 degrees, and in which the modified machine corresponded to the example set forth below.

An optional feature which may be used with the foregoing improvements is an impact breaker member/-cage combination which has eliminated the difficulties associated with the gap 33 of FIG. 1. This option may best be seen in FIG. 4, which discloses an impact breaker member 18 having a downstream portion which pivots and cooperates with a portion of the cage to eliminate the gap. As shown in the figure, impact breaker member 18 includes not only a first portion 23 fixed in the apparatus but also an optional but preferred second portion 25 which is further downstream and which is pivoted in a manner to be described below.

Figure 4:
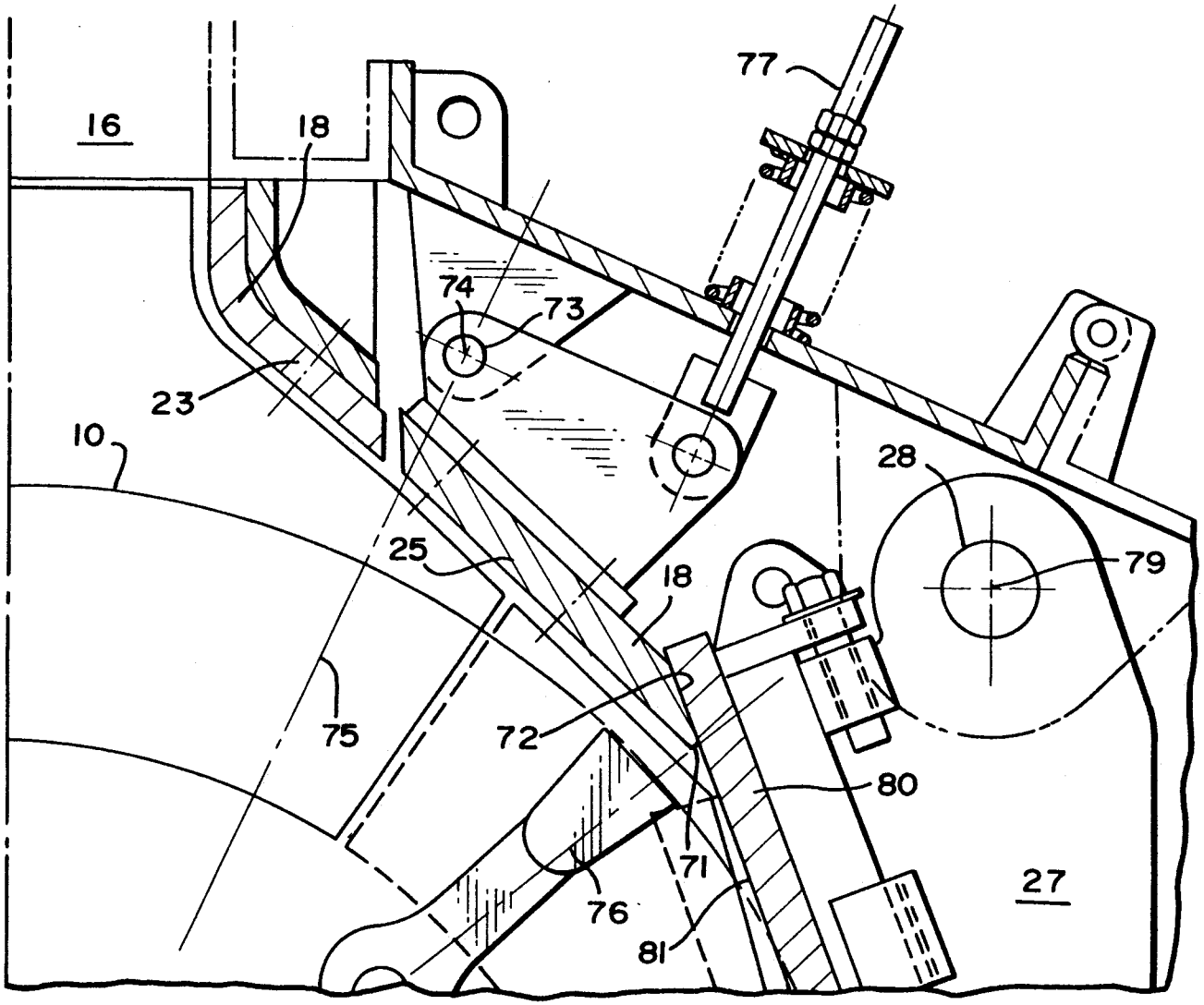
FIG. 4 is also an enlarged portion of FIG. 2, showing an improved arrangement of the impact breaker member and the cage, along with certain features of the frame side piece-liners which have been adapted for use with the cage assembly of FIGS. 2 and 3.

Thus, according to FIG. 4, the pivoted second portion 25 of the impact breaker member has a downstream edge 71 with rear contact surface 72. This downstream portion of the impact breaker member is pivotally mounted for pivoting of this downstream edge toward and away from hammer circle 10. For this purpose, the aforesaid downstream portion is supported on an impact breaker pivot 73 having a breaker pivot axis 74 which is substantially parallel to rotor shaft axis 4, shown in FIG. 2. As viewed in transverse cross-section in FIG. 4, breaker pivot axis 74 is positioned on a first radial 75 of the shaft axis 4. Downstream edge 71 coincides with an additional radial or radials 76 of shaft axis 4 as that edge pivots. First radial 75 is located upstream of the additional radial or radials 76. Means of any appropriate type, such as spring loaded bolts 77, are provided for urging at least the downstream edge 71 away from the hammer circle.

As indicated above and further illustrated in FIG. 4, the cage has a pivot 28 which is connected with the cage frame for pivoting portions of the working face toward and away from the hammer circle, and which in this embodiment is independent of the breaker pivot 73. Cage pivot 28 typically has a cage pivot axis 79 that is generally parallel to shaft axis 4. According to the present preferred embodiment of this invention, the cage includes a striker member 80 which extends generally parallel to shaft axis 4 on cage frame 27 and is positioned for maintaining contact with the rear contact surface 72 of the impact breaker member during pivoting of the cage frame about pivot axis 79. According to a particularly preferred embodiment, striker member 80 includes a breaker plate surface 81 of substantial area positioned in the working face of the cage and extending downstream from the downstream portion of the impact breaker member.

The foregoing pivoting downstream portion of the impact breaker member may be employed with or without the particular shearing member/impact breaker member improvements described above. Moreover, the shearing member/impact breaker member improvements may be practiced with or without the pivoting downstream portion of the impact breaker member. However, in typical commercial embodiments, both of these beneficial modifications will be utilized together.

Example

In the following illustrative example, the indicated parameters correspond with what is currently believed to be the best mode of practicing the invention. The unit of this example is a reversible hammermill corresponding in its design and spatial relationships to that illustrated in FIGS. 2–4 herein. The preferred hammers are pivotable hammers arranged in staggered rows so that the hammers in a succeeding row rotate into the gaps between adjoining hammers in the preceding row. The following additional parameters apply:

| | |
|---|---|
| Location of In-Feed Position | centered on twelve o'clock |
| Arc Subtended by In-Feed Position | 30 degrees |
| Arc Subtended by Impact Breaker Member (including portion on cage) | 50 degrees |
| Shearing Bar Cross-Section | Rectangular |
| Shearing Bar Thickness | ½ inch |
| Shearing Bar Depth (radial dimension) | 4 inches |
| Shearing Bar Material | Ryerson AR-360 Steel Plate or Equal |
| Shearing Bar Hardness | 360 Brinnell |
| Shearing Bar Angular Spacing | ¼ inch |
| Ratio of Shearing Bar Angular Spacing to Angular Width | 0.5 |
| Number of Shearing Members per Peripheral Inch of Working Face | 1.3 |
| Angular Interval of Hammer Circle Subtended by Shearing Bars | 40 degrees |
| Screening Bars | as described in De Feo U.S. Pat. No. 3,591,096 or equivalent |
| Screening Bar Angular Width | 1 inch |
| Screening Bar Angular Spacing | ¾ to 1¼", and no smaller than necessary for desired product size |
| Ratio of Screening Bar Angular Spacing to Angular Widths | 0.75–1.25 |
| Number of Screening Members per Peripheral Inch of Working Face | 0.57–0.44 |
| Angular Interval of Hammer Circle Subtended by Screening Bars | 50 degrees |
| Initial Location of Pinch Point | upstream end of shearing bar arc |
| Pinch point location, worn machine | downstream end of shearing bar arc |
| Position of Top of Shearing Bar Intervals | 20 degrees above 3 and 9 o'clock positions |

It will be appreciated that the foregoing description is merely illustrative of the invention and that a wide variety of alternatives can be practiced without departing from the spirit of the invention.

What is claimed is:

1. Comminuting apparatus for comminuting by sequential action of impact and shearing members, said apparatus comprising:

A) a rotor mounted for rotation about an axis of rotation and comprising a shaft and hammers mounted in at least one circular array for rotation with said shaft, said hammers having peripheral surfaces or edges defining a hammer circle upon rotation of said shaft, B) means for introducing feed particulates to the rotor
1) from outside the hammer circle,
2) with a component of motion directed radially inward with respect to the axis, and
3) at an in-feed position on the hammer circle, C) an impact breaker member
1) located opposite a portion of the hammer circle adjacent the in-feed position and
2) having at least one surface extending in a direction of rotation of said rotor and convergent with the hammer circle for crowding feed particulates against the rotor, D) a cage having a generally arcuate inner working face confronting and adjacent to the hammer circle and including
1) a cage frame, and
2) plural grinding members supported by the frame in at least one array for forming the working face,
a) said members being mounted and distributed in or on the frame in a generally arcuate pattern at least partially surrounding the hammer circle,
b) with the lengths of said members lying generally parallel to the axis,
c) with said members being angularly spaced from one another about said axis, d) said members having inner surfaces confronting and adjacent to the hammer circle, and e) at least a portion of said grinding members being at least one group of shearing members in angularly consecutive series within which
(1) the angular width of said shearing members is about one half inch or more,
(2) the angular spacing of said shearing members is about one eighth of an inch or more,
(3) the ratio of angular spacing to angular width of said shearing members is about 0.15 or more,
(4) the number of shearing members per peripheral inch of that portion of the working face occupied by the shearing members is at least one; and
(5) the angular interval of the hammer circle subtended by said group or groups of shearing members represents at least about 30 degrees, at least a portion of the arc subtended by the shearing members extending above the three o'clock position of the hammer circle, for causing the major portion of feed particulates traversing the series of shearing members to skip over the inner surfaces of the shearing members, and f) at least a portion of said grinding members being at least one group of screening members in angularly consecutive series within which
(1) the angular width of said screening members is about one inch or more,
(2) the angular spacing of said screening members is about three quarters of an inch or more,
(3) the ratio of angular spacing to angular width of said screening members is about 0.5 or more,
(4) the number of scanning members per peripheral inch of that portion of the working face occupied by the screening bars is less than one and
(5) the angular interval of the hammer circle subtended by said group or groups of screening members represents at least about 45 degrees, for causing the major portion of feed particulates traversing the series of screening members to exit the hammer circle via the spaces between the inner surfaces of the screening members.

2. Apparatus according to claim 1 wherein said rotor and cage have a pinch point at which the hammer circle approaches closest to the working face, and wherein said apparatus includes means for adjusting the cage to move the pinch point downstream along the hammer circle, and for moving the pinch point from a location which is at or upstream of the upstream end of the series of shearing members when the comminuting components of the apparatus are substantially unworn, to a location opposite the series of shearing members and a substantial distance downstream of said upstream end when the comminuting components are substantially worn.

3. Apparatus according to claim 1 wherein said rotor and cage have a pinch point at which the hammer circle approaches closest to the working face, and wherein said pinch point is located at or upstream of the upstream end of the series of shearing members.

4. Apparatus according to claim 1, 2 or 3 wherein the angular interval of the hammer circle subtended by the shearing members represents at least about 35 degrees.

5. Apparatus according to claim 1, 2 or 3 wherein the angular interval of the hammer circle subtended by the shearing members represents about 40 to about 45 degrees.

6. Apparatus according to claim 1 wherein the angular interval of the hammer circle subtended by the shearing members represents about 30 to about 60 degrees.

7. Apparatus according to claim 1, 2 or 3 wherein that portion of the shearing member arc which extends above the three o'clock position of the hammer circle subtends at least about 10 degrees of the hammer circle.

8. Apparatus according to claim 1, 2 or 3 wherein that portion of the shearing member arc which extends above the three o'clock position of the hammer circle subtends at least about 15 degrees of the hammer circle.

9. Apparatus according to claim 1, 2 or 3 wherein that portion of the shearing member arc which extends above the three o'clock position of the hammer circle subtends at least about 20 degrees of the hammer circle.

10. Apparatus according to claim 1, 2 or 3 wherein a portion of the shearing member arc extends below the three o'clock position.

11. Apparatus according to claim 1 wherein the hammers are pivotable hammers.

12. Apparatus according to claim 1 wherein the shearing members are bars.

13. Apparatus according to claim 1 wherein the screening members are bars.

14. Apparatus according to claim 1 wherein the shearing and screening members are bars.

15. Apparatus according to claim 1, 2 or 3 wherein the shearing members include a series of bars in which, as viewed in transverse cross section, the inner downstream edge of each respective bar is separated sufficiently from the inner, upstream edge of the next succeeding bar downstream, for permitting particulates passing over each respective bar to make contact with the inner, upstream edge of the succeeding bar.

16. Apparatus according to claim 1, 2 or 3 wherein the shearing members, as viewed in transverse cross section, have angular intervals of space between them, and said spaces are of sufficiently small size for preventing entry into said spaces by the majority of particulates passing over the respective bars.

17. Apparatus according to claim 1 wherein the rotor is adapted for rotation clock-wise or counterclockwise about the axis, and wherein the apparatus has a pair of said impact breaker members and a pair of said cages, one member of each of said pairs being arranged in symmetrical relationship with the other member of the respective pair on opposite sides of a plane of symmetry extending vertically through the axis.

* * * * *